United States Patent [19]

Nokes

[11] 4,402,201

[45] Sep. 6, 1983

[54] SNAP-OFF KEY

[76] Inventor: Clarence Nokes, 120 Third St., NE., Washington, D.C. 20002

[21] Appl. No.: 207,032

[22] Filed: Nov. 14, 1980

[51] Int. Cl.[3] ..... E05B 19/26

[52] U.S. Cl. ..... 70/395; 70/410

[58] Field of Search ..... 70/395, 410, 411, 422

[56] References Cited

U.S. PATENT DOCUMENTS

| | | | |
|---|---|---|---|
| 1,528,641 | 3/1925 | Vives | 70/411 |
| 1,573,791 | 2/1926 | Roethlisberger | 70/395 |
| 2,591,652 | 4/1952 | Ziegliss | 70/395 |
| 3,338,365 | 8/1967 | Hoffberger | 70/410 |

FOREIGN PATENT DOCUMENTS

| | | | |
|---|---|---|---|
| 418596 | 12/1923 | Fed. Rep. of Germany | 70/410 |

*Primary Examiner*—Robert L. Wolfe

*Attorney, Agent, or Firm*—James C. Wray

[57] ABSTRACT

The invention is a unibody key with lateral grooves on one side or both sides of the shank of the key. The lateral grooves are of an irregular pattern and are cut at a depth such that the key can be snapped off along the lateral groove. The snapped-off portion ofthe key can be inserted in a lock. By inserting the snapped-off portion in the lock, only a key which will mate with the irregular pattern of the snapped-off portion will give proper alignment for a key to open such lock. By such operation, the key necessary to open the lock is easily, quickly and effectively changed.

12 Claims, 3 Drawing Figures

FIG. 1
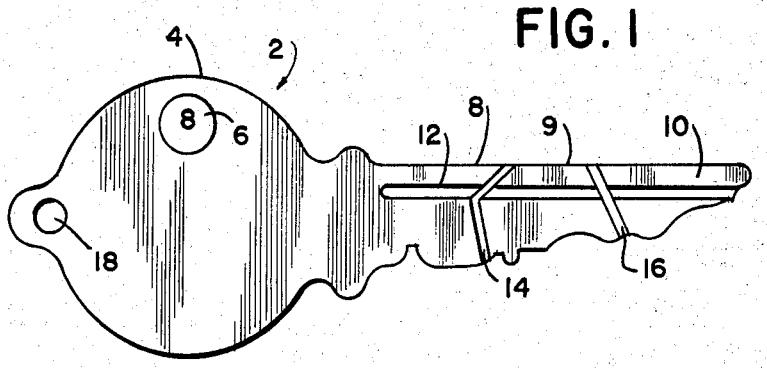
FIG. 2
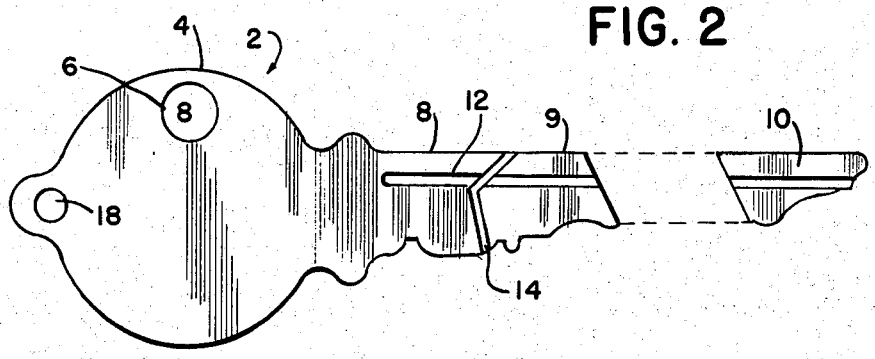
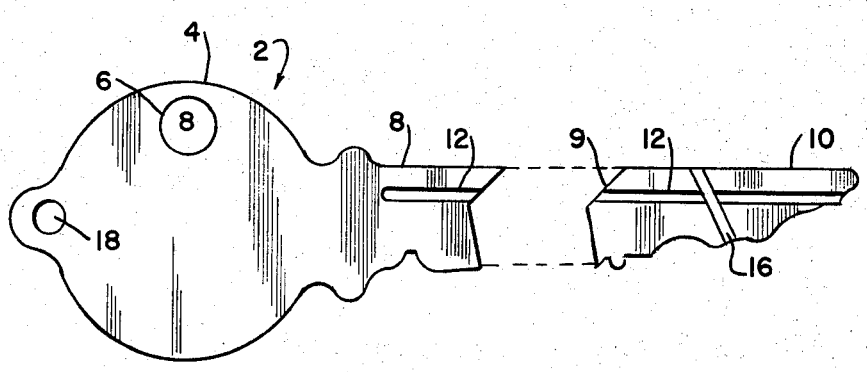
FIG. 3

SNAP-OFF KEY

BACKGROUND OF THE INVENTION

It is known to have keys which consist of multiple parts. In the past separable keys consisted of discreet parts whereby the separate parts were joined by some mechanical means.

The parts that were connected by such mechanical means and separable from the remainder of the key were the entire shank portion, a portion of the shank portion with protuberances, and an end portion of the shank portion.

In such situations, the parts were separable and the key was not formed of one piece (i.e., unibody). In most cases the separable portion could be attached and detached at the whim or necessity of the user. The keys of this type were not of a unibody construction.

SUMMARY OF INVENTION

The present invention is a means to quickly change the key shape needed to open a lock. In the event keys are lost or stolen, a person can effectively change his or her lock to prevent anyone who found or stole the keys from using such keys from entering the owner's house, apartment, etc.

The key of the invention has the body and shank and longitudinal grooves of a standard key. The edge of the shank can be cut to provide protuberances for opening a specific lock. The key has lateral grooves which extend laterally across the shank of the key. The lateral grooves are disposed on one or both sides of the key shank.

The lateral grooves are angled, multi-angled or in other irregular patterns across the lateral face of the shank.

The lateral grooves are cut to a depth which will allow the key to be snapped off along the lateral groove, dependent on the irregular pattern of the groove.

The snap-off key is originally cut from a standard key blank and then the lateral grooves are cut in the shank. When the snap-off key is in a finished form, it is of a unibody with lateral grooves cut in the lateral face of the shank.

In operation, when a person loses his or her keys or the keys are stolen, he will remove the snap-off key, which fits the appropriate lock, from a wallet, purse or other hidden storage place and snap off a portion of the key and insert the snapped-off portion into the lock. Once this has been accomplished, the lock has effectively been changed.

To open the lock after the snapped-off portion has been inserted in the lock, the person wishing to open such lock must have the exact irregular pattern which will mate with the snapped-off portion so proper alignment of the key is realized to open the lock. If another key shape is attempted to be used to open the lock, it will not be successful because there will not be proper alignment of the key to turn the lock. This will provide security until the lock is changed or the portion inserted may be left in the lock permanently.

When the key of the invention is used, it is cut along with a standard key with no lateral grooves, thus one key is a standard key with no lateral grooves, and a second key has lateral grooves. Additionally, another key may be cut from a plastic blank which will provide a key which is exactly the shape of the original key that was lost or stolen and can serve as a model for reproducing the original key, if desired.

The snap-off keys are marked with an identification numeral which will identify not only the original by shape, but, more importantly, the irregular pattern of lateral grooves. This is very important in case the lobe and remaining portion of the key are lost after a portion has been snapped off and inserted in the lock. By providing the proper identification numeral, the proper key with the proper irregular pattern of the lateral groove can be identified.

The object of the invention is to provide a unibody key with lateral grooves where the key can be snapped-off along the lateral grooves and the snapped-off key portion can be inserted in the lock to effectively change the key needed to open the lock.

Another object of the invention is to provide grooves on a snap-off key which are of a depth that the key can easily be snapped off along the grooves.

Another object of the invention is to provide lateral grooves of an irregular pattern so the portion that is snapped-off and inserted in a lock would be hard to mate.

DESCRIPTION OF THE DRAWINGS

FIG. 1 shows a side view of the snap-off key before any portions have been snapped off.

FIG. 2 shows a side view of a snap-off key snapped off at the first lateral grooves.

FIG. 3 shows a side view of the snap-off key snapped off at the second lateral grooves.

DETAILED DESCRIPTION OF THE DRAWING

FIG. 1, generally at 2, shows the unibody key with lateral grooves 14 and 16. The key 2 has lobe portion 4 with a means to hang the key at 18. The shank portion of the key 8, 9 and 10 has longitudinal groove 12. The lateral grooves 14 and 16 may be on one side or the lateral grooves may be adjacent on each lateral face of the shank portion in direct opposition to each other. The depth of lateral grooves 14 and 16 is that which is needed to readily snap off portion 10 or portion 9/10 (FIGS. 2 and 3 respectively).

Each snap-off key has an identification numeral 6 to make it easy to identify a replacement snap-off key blank.

Referring now to FIG. 2, when portion 10 is snapped-off and inserted in a lock (not shown), the lock can be opened by the remaining portions: the lobe 4 and shank portions 8 and 9. The edge of portion 9 and edge of portion 10, which was previously lateral groove 16, mate for proper alignment of the key to open the lock.

FIG. 3 utilizes the same procedure as FIG. 2 except the key is snapped off at lateral groove 14.

The key 2 can be snapped-off at groove 16, and portion 10 may be inserted in the lock. This will effectively change the key needed to open the lock. At a subsequent time, portion 9 may be snapped-off to effectively change the key needed to open the lock a second time. It follows that the number of lateral grooves on the key will determine the number of times the key needed to open the lock may be changed.

The invention contemplates the use of all equivalents to those described herein.

I claim:

1. A snap-off key comprising:

a key body further comprising a lobe portion and a unitary shank portion;

said shank portion further comprising a plurality of longitudinally disposed grooves on one or both lateral faces, a plurality of protuberances disposed along one or both edges and one or a plurality of score grooves cut substantially lateral across said shank portion in an irregular pattern.

2. A snap-off key comprising a key body further comprising a lobe portion and a shank portion, said shank portion further comprising a plurality of longitudinally disposed grooves on one or both lateral faces, a plurality of protuberances disposed along one or both edges and one or a plurality of grooves cut substantially lateral across said shank portion, wherein the lateral disposition of said lateral groove is an irregular pattern, and wherein said lateral grooves are cut in only one lateral face.

3. The lateral grooves of claim 2 wherein said lateral groove has a depth less than one half the thickness of said shank portion.

4. The lateral grooves of claim 1 wherein said lateral grooves are cut in both lateral faces.

5. A snap-off key comprising a key body further comprising a lobe portion and a shank portion, said shank portion further comprising a plurality of longitudinally disposed grooves on one or both lateral faces, a plurality of protuberances disposed along one or both edges and one or a plurality of grooves cut substantially laterally across said shank portion, wherein said lateral grooves are cut in both lateral faces, and wherein said lateral grooves are cut adjacent to one another on respective lateral faces and in direct opposition.

6. The adjacent grooves of claim 5 are cut at a depth wherein the thicknes between the low point of one groove and the low point of the opposing groove is greater than one half the thickness of said shank portion.

7. A snap-off key of claim 2 wherein:

8. The lateral grooves of claim 7 wherein said lateral groove has a depth less than one half the thickness of said shank portion.

9. The lateral grooves of claim 7 wherein said lateral grooves are cut in only one lateral face.

10. A method of using a snap-off key comprising:

snapping off a portion of a shank of said key along a lateral groove having an irregular pattern inserting the snapped-off portion into a lock;

inserting a remaining portion of said key into said lock and the aligning irregular pattern of said remaining portion with the irregular pattern of said snapped-off portion opening said lock by turning said remaining portion.

11. The lateral grooves of claim 5 wherein said shank portions are capable of being snapped-off and separated substantially along the lateral grooves.

12. The adjacent grooves of claim 11 are cut at a depth wherein the thickness between the low point of one groove and the low point of the opposing groove is greater than one half the thickness of said shank portion.

* * * * *